United States Patent [19]

Mandlak

[11] 4,051,981

[45] Oct. 4, 1977

[54] POWDER GUN

[76] Inventor: Louis John Mandlak, 116 Athenia Drive, Fort Worth, Tex. 76114

[21] Appl. No.: 640,621

[22] Filed: Dec. 15, 1975

[51] Int. Cl.[2] ..... B05B 7/14; B05B 11/04

[52] U.S. Cl. ..... 222/189; 222/193; 222/206; 222/459; 209/2.53

[58] Field of Search ..... 222/189, 206, 215, 193, 222/565, 459; 209/253, 271

[56] References Cited

U.S. PATENT DOCUMENTS

| | | | |
|---|---|---|---|
| 6,015 | 8/1874 | Crossman | 222/459 |
| 204,564 | 6/1878 | Haines | 222/459 |
| 1,613,469 | 1/1927 | McEvoy | 209/253 |
| 2,349,875 | 5/1944 | Mandlak | 222/189 |
| 2,645,382 | 7/1953 | Plough | 222/565 X |
| 2,764,319 | 9/1956 | Weimer | 222/215 |
| 2,772,816 | 12/1956 | Denvor | 222/189 |
| 3,151,781 | 10/1964 | McKee | 222/565 X |

FOREIGN PATENT DOCUMENTS

| | | | |
|---|---|---|---|
| 494,470 | 5/1954 | Italy | 222/193 |
| 705,302 | 3/1954 | United Kingdom | 222/215 |
| 1,079,834 | 8/1967 | United Kingdom | 222/189 |

*Primary Examiner*—Robert B. Reeves
*Assistant Examiner*—Frederick R. Handren
*Attorney, Agent, or Firm*—James C. Fails

[57] ABSTRACT

A powder gun for dispensing a powder such as an insecticide or the like characterized by a hollow collapsible body for containing the powder, a dispensing member having a discharge port and spout for directing the discharged powder into the desired area and connected with the hollow collapsible body, and a filter and lump break up means disposed within the dispensing member immediately adjacent the discharge port for breaking up lumps and for filtering the powder and preventing entry of particles large enough to plug the discharge port and spout. The hollow collapsible body is normally biased to an extended position and movable to a compressed position for discharging air and any powder therewithin through the dispensing member. Also disclosed are preferred structural embodiments including a rotatable disc having multiple sections of stalks protruding substantially perpendicularly thereto for breaking up the lumps and for filtering the powder dispensed through the discharge spout, as well as preferred materials of construction.

2 Claims, 6 Drawing Figures

13
11
21
19
49
25
39
43
23
15
29
17
41
45
47
35
37
33
27
31

POWDER GUN

BACKGROUND OF THE INVENTION

1. Field of the Invention

This invention relates to dispensing containers. More particularly, it relates to the type of dispensing container known as a powder gun for dispensing a powder into a desired area, or region.

2. Description of the Prior Art

A wide variety of different types of dispensing containers have been known in the prior art. There have been dispensing containers for dispensing liquids or semi-liquids, and containers for dispensing salt and other particulate solids. Illustrative of the former are U.S. Pat. No. 2,738,107, a receptacle for an atomizer or the like; U.S. Pat. No. 3,390,821, a collapsible container; U.S. Pat. No. 3,506,163, an article for holding and dispensing flowable materials; and U.S. Pat. No. 3,833,154, a dispensing container for dispensing a fluid and having a one-way valve. Illustrative of the latter are U.S. Pat. No. 875,531 and 2,756,909 for dispensing salt and 2,808,970 containing a dispensing cap.

In spite of the wide variety of different types of containers known, the closest art of which I am aware is U.S. Pat. No. 2,349,875, my own patent on a powder gun. That powder gun, similarly as the rest of the prior art, suffered from a disadvantage of lacking any way of providing a controllable filter and for breaking up lumps that tended to form in any of the myriad powdered material to be dispensed for any purpose. Typical of the materials employed are powders such as sulfur, arsenic compounds, and the like for treating vegatation such as roses, insecticides such as DDT powder and the like, powder employed for controlling roaches, rodents, ants and other household pests.

In the prior art, the dispensing containers fequently had a plurality of apertures such that they were filled from one end and dispensed from another end. When corks, or other friction type plugs were held at the filling end, there was a tendency of plugging of the discharge spout such that the filling cork would be inadvertently blown from the container when the bellows-like container was compressed for discharging the powder.

Moreover, the prior art was deficient in not providing a spout that could dispense a coarse cloud of powder where desired, or could dispense a finely controlled powder directionally into cracks and the like, as well as providing the filtering and breaking up action.

SUMMARY OF THE INVENTION

Accordingly, it is an object of this invention to provide a powder gun that obviates the disadvantages of the prior art and allows dispensing powders of varying degrees of fineness while simultaneously breaking up lumps that tend to form and preventing plugging of the dispensing spout.

It is a specific object of this invention to provide an economical container that can be readily filled and dispensed from a single opening; can dispense powder from within, in a semi-aerosol form; can dispense the powder of varying degrees of fineness and break up any lumps that tend to form therein; and can dispense the coarse powder in a cloud-like form, or dispense the powder in a fine, accurate spray for small crevices and the like.

These and other objects will become apparent from the following descriptive matter, particularly when taken in conjunction with the appended drawings.

In accordance with this invention, there is provided a powder gun that effects the objects delineated hereinbefore and is characterized by a hollow collapsible body having an aperture at one end and being connected with a dispensing member having a discharge port and spout; having a filter and lump break up means disposed within the dispensing member immediately adjacent the discharge port and spout for breaking up lumps and for filtering the powder and preventing entry of particles large enough to plug the discharge spout. The filter and lump break up means comprise a plurality of sections for achieving the respective degrees of fineness of the powder filtered therethrough and being movable to position the respective section to obtain the desired degree of fineness. The hollow collapsible body has an aperture at one end for both filling and dispensing of the powder and obviates difficulties with blowing corks or the like from openings opposite the dispensing opening.

Figures 1, 2, 3, 4, 5, 6:
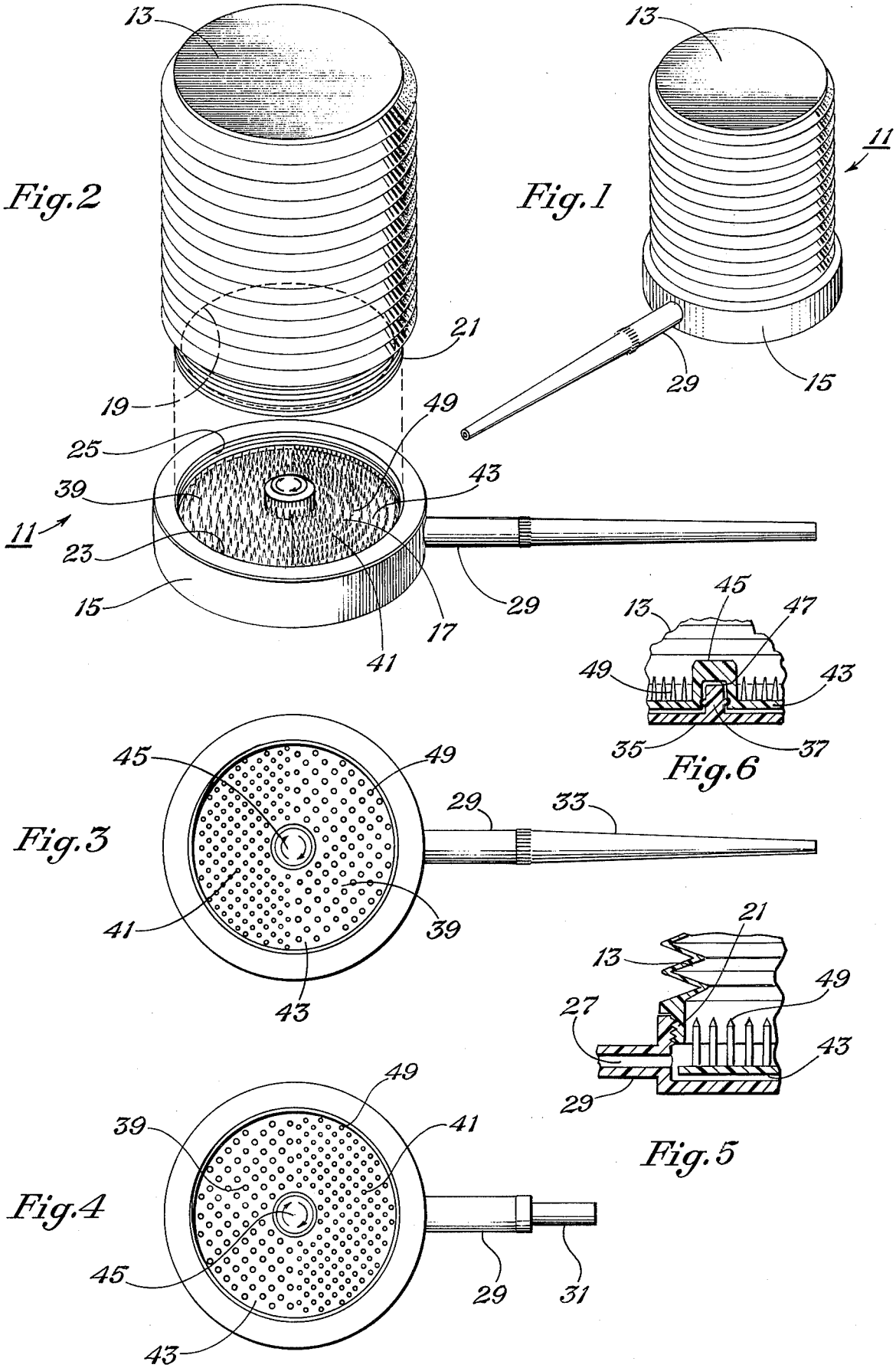
FIG. 1 is a perspective view of a powder gun in accordance with one embodiment of this invention.
FIG. 2 is a disassembled view of the powder gun of FIG. 1 showing the filter therewithin.
FIG. 3 is a plan view of the dispensing member of FIG. 2 with a finely directing spout thereon.
FIG. 4 is a plan view of the dispensing member of FIG. 2 with a coarse-directing spout and with the filter rotated so as to be opposite that of FIG. 3.
FIG. 5 is a partial cross sectional view showing the filter stalks guarding the discharge port.
FIG. 6 is a partial cross sectional view showing the rotatable mounting of the filter and lump break up means.

DESCRIPTION OF PREFERRED EMBODIMENT(S):

Referring to the Figures, and particularly FIGS. 1 and 2, the powder gun 11 includes a body 13 for holding the powder to be dispensed, a dispensing member 15 for dispensing the powder, and a filter and lump break up means 17 for maintaining powder in a dispensible form.

The body 13 is a hollow collapsible body that is normally biased to an extended position but is movable to a compressed position for discharging air and any powder therewithin from the body. As illustrated, the biasing means that is employed in the collapsible body for maintaing it normally biased in the extended position comprises corrugated, or pleated, plastic in the form of a bellows arrangement in which the normal strength of the plastic resists compression and biases it toward its extended position. If desired, a spiral spring may be wound interiorly of the exterior surface of the body 13 for biasing it to an extended position. As illustrated, the hollow collapsible body 13 has a first aperture 19 at its one end, or bottom. The first aperture 19 is large so as to facilitate filling of the body 13 with the powder to be employed, particularly when in the inverted position, or opposite from that illustrated in FIG. 2. Inherently, the aperture 19 will have a bore extending upwardly into the body 13. Thus, the bore is defined by a cylindrical side wall that forms the basis for a threaded portion 21 to be formed. With this structure, the body 13 has no filling opening from which a stopper or the like would be blown as in the prior art, such as my U.S. Pat. No.

2,349,875. The powder may comprise any of the conventional insecticides, fungicides, rodenticides, weedicides, powders for treating plants, or the like. The body 13 includes a threaded portion 21 that serves as a first connection means portion for connecting the hollow collapsible body to the dispensing member 15.

The dispensing member 15 has a second aperture 23 adapted to mate with the first aperture of the hollow collapsible body. The dispensing member 15 also includes female threaded portion 25 that serves as a second connection means portion for matingly connecting to the first connection means portion for connecting the hollow collapsible body to the dispensing member. As illustrated, the female threaded portion 25 defines the second aperture 23 and allows the powder to be discharged. A discharge port 27, FIG. 5, penetrates through the side wall in the dispensing member 15 below the threaded portion 21 of the body for discharging the powder. The discharge port 27 has a bore that continues longitudinally of a discharge spout 29, FIGS. 1-5.

Because the powder gun can be employed to dispense a wide variety of powders, the discharge spout 29 comprises a stub spout 31 for discharging the powders in a cloud-like form, and a fine spout, or extension, 33 for improved directional control of the powder, as for small crevices and the like. As illustrated, the fine spout 33 slips over and frictionally engages the stub spout 31 for retention in place. If desired, the stub spout and the fine spout may have mating threaded connections for more rigidly holding the fine spout in place. This has not been found necessary to date, however. As illustrated, the dispensing member 15 has a substantially planar bottom, or bottom wall, 35, FIG. 6, and has a protruding shaft 37 for mounting of the filter and lump break up means 17.

The filter and lump break up means 17 is disposed in the dispensing member immediately adjacent the discharge port 27 for breaking up lumps and for filtering the powder and preventing entry of particles large enough to plug the discharge spout 27. The filter and lump break up means 17 comprises a plurality of sections 39 and 41, FIGS. 2-4, for providing respective degrees of fineness of the powder filtered therethrough. The filter and lump break up means 17 is movable to obtain the position of the desired section so as to obtain the desired degree of fineness adjacent the discharge port 27. Specifically, the filter and lump break up means 17 comprises a rotatable disc 43, FIGS. 2-6, that is rotatably mounted in the discharge means 15. Specifically, the disc has a central knob 45 that defines concentrically therewithin a recess 47, FIG. 6, that conformingly fits over the protruding shaft 37. The disc 43 is substantially planar to rest along the planar bottom 35 of the dispensing member 15 to maintain its position when it is rotated, as by the knob 45. As can be seen, the knob 45 protrudes above the respective stalks 49 that make up the respective sections of the filter and lump break up means. Expressed otherwise, the stalks 49 are disposed at a predetermined angle, such as substantially perpendicular, with respect to the disc 43; and are disposed at respective predetermined distances apart in each of the respective sections to achieve the desired filtering action. The stalks 49 are tall enough to protect entry to the discharge port 27 and are sized and shaped to achieve the desired break up of any lumps that tend to form in the powder to be dispensed. Stalks 49 may have any particular type end desired. For example, they may have pointed ends, squared off ends, or rounded ends. Ordinarily, the stalks will have a pointed end for most advantageously breaking up the lumps into the powder when the powder and the lumps therewithin are shaken. Specifically, the lumps are shaken into sharp contact with the stalks 49 and reduced to powder for being dispensed. The powder is caused to move laterally between the stalks in order to be discharged; hence, the filtering action. The disc and the stalks are held in place when the body 13 is screwed into position.

All of the respective elements delineated and described hereinbefore are formed of plastic in order to resist corrosion by the various powders that may be employed. Several of the various powders have been found to be extremely corrosive to metallic parts. Any of the conventional plastics may be employed. For example, a variety of thermoplastic and thermosetting plastics are employed for the respective elements. Typical are polyvinylchloride, high density polyethylene, polypropylene, polybutylene, acrylonitrile butadiene styrene copolymer (ABS), Nylon, and the like. Certain portions may be formed from plastic such as Delrin and Orlon.

In operation, the body is inverted from the position shown and filled to the desired volume with the powder to be dispensed. The dispensing member 15, with its filter and lump break up means 17 in place and frictionally held on the protruding shaft 37, is rotated to obtain the desired fineness section adjacent the discharge port 27. Thereafter, the dispensing member 15, with the desired spout emplaced, is screwed onto the threaded portion 21. The powder may be dispensed in a very dilute form by leaving the body 13 on the bottom such that the air entrains the powder and is dispensed out the spout. On the other hand, the powder may be dispensed in a more concentrated form by positioning the powder gun 11 with the body 13 on top, as illustrated in FIGS. 1 and 2. When fresh powder with no lumps is employed, there is no problem with dispensing. After the powder gun has been allowed to sit for a while, however, lumps tend to form so that it may be necessary to shake the powder in the body 13 and break up the lumps into the desired powder. It is at this point that the value of the filter and break up means becomes significant in breaking up the lumps and in filtering the powder.

When it is desired to change the fineness of the powder, the dispensing member 15 is unscrewed from the body 13 and the knob 45 rotated to emplace the section of the desired fineness adjacent the discharge port 27. Ordinarily, the filter and lump break up means 17 will be positioned as illustrated in FIG. 1, or oppositely to the positions illustrated in FIG. 3, when it is desired to dispense fine powder out the fine spout 33. Of course, if the coarse section 39 allows entry into the spout 29 of particles that are large enough to plug the fine spout 33, the filter 17 should be rotated until such large particles are blocked, or prevented from entering the spout. The filter 17 may be positioned opposite to that shown in FIG. 4 when coarse powder is to be distributed out the stub spout 31. The gun is again assembled and the powder dispensed as described hereinbefore.

If desired, even three or more sections can be employed in the filter and lump break up means 17.

When it is desired to change out the powder and form a new powder, the body 13, dispensing member 15, and the filter and lump break up means 17 may be readily washed to rid them of the old powder. This is particularly important where certain hormone type weed killers, such as 2-4-D, are employed.

While a stub shaft and frictionally fitting recess have been described hereinbefore with respect to the rotatable mounting of the filter and lump break up means 17, any other suitable means may be employed. For example, the filter may have a shaft that protrudes through the bottom 35 and have a C-clamp with suitable annular recess for holding it in place. Such a structure still facilitates disassembly for cleaning or the like. On the other hand, the filter may have mating threads to thread into the female threads 25 and fall from the bottom end of the threads into an unthreaded portion to be retained in place, yet readily removed by being screwed from the unthreaded portion by lifting up into the threads and unscrewing.

A threaded interconnection has been described hereinbefore with respect to affixing of the dispensing member 15 to the hollow collapsible body 13. If desired, any of the other conventional means employed in this art may be employed herein. For example, there may be snap-in fittings, twist engaging flanges and recesses, or the like.

Although this invention has been described with a certain degree of particularity, it is understood that the present disclosure has been made only by way of example and that numerous changes in the details of construction and the combination and arrangement of parts may be resorted to without departing from the spirit and the scope of this invention.

What is claimed is:

1. A powder gun adapted for dispensing a powder regardless of lumps that may tend to form therein comprising:

a. a hollow collapsible body that is normally biased to an extended position and movable to a compressed position for discharging air and any powder therewithin from said body through an aperture and a dispensing member; said hollow collapsible body including:

i. a first aperture at one end; and ii. a first connection means portion for connecting said hollow collapsible body to a dispensing member;

b. a dispensing member having:

i. a second aperture adapted to mate with said first aperture of said hollow collapsible body;

ii. a second connection means portion for matingly connecting to said first connection means portion for connecting said hollow collapsible body to said dispensing member, said second connection means portion being disposed adjacent said second aperture;

iii. a discharge port disposed in said dispensing member and penetrating through a wall thereof for discharging powder therethrough; and iv. a discharge spout connected with said discharge port for directing said discharged powder into a desired area; and c. a filter and lump break-up means disposed in said dispensing member immediately adjacent said discharge port for breaking up lumps and for filtering said powder and preventing entry of particles large enough to plug said discharge spout; said filter and lump break-up means comprising a rotatable disc rotatably mounted in said discharge member and having at least two sections of upstanding stalks disposed at a predetermined angle with respect to said disc; said stalks being of respective predetermined diameters and disposed at respective predetermined distances apart in the respective sections to achieve the desired filtering action and being sized and shaped to achieve the desired break up of any lumps that tend to form.

2. The powder gun of claim 1 wherein said disc is substantially planar and said stalks are disposed substantially perpendicularly to the planar disc such that all of said stalks are available to break up any lumps to form, even when only a section is disposed adjacent said discharge port.

* * * * *